US008490966B2

(12) United States Patent
Iwama et al.

(10) Patent No.: US 8,490,966 B2
(45) Date of Patent: Jul. 23, 2013

(54) RECORDING MEDIUM SUPPORT DEVICE AND RECORDING APPARATUS

(75) Inventors: Kazuyoshi Iwama, Matsumoto (JP); Mami Hashizume, Ina (JP); Kenji Oshima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 1218 days.

(21) Appl. No.: 12/175,158

(22) Filed: Jul. 17, 2008

(65) Prior Publication Data

US 2009/0022539 A1 Jan. 22, 2009

(30) Foreign Application Priority Data

Jul. 20, 2007 (JP) ..... 2007-190044

(51) Int. Cl.
*B65H 1/00* (2006.01)

(52) U.S. Cl.
USPC ..... 271/162; 271/145

(58) Field of Classification Search
USPC ..... 271/145, 162
See application file for complete search history.

(56) References Cited

U.S. PATENT DOCUMENTS

| | | | | |
|---|---|---|---|---|
| 5,238,235 | A * | 8/1993 | Nitta et al. | 271/9.09 |
| 6,000,692 | A * | 12/1999 | Lee | 271/248 |
| 6,213,464 | B1 * | 4/2001 | Inoue et al. | 271/248 |
| 6,810,231 | B2 * | 10/2004 | Kobayashi et al. | 399/367 |
| 7,360,959 | B2 * | 4/2008 | Sawada et al. | 400/642 |
| 7,520,502 | B2 * | 4/2009 | Maeda | 271/162 |
| 7,722,033 | B2 * | 5/2010 | Matsumoto et al. | 271/162 |
| 7,926,804 | B2 * | 4/2011 | Chinzei et al. | 271/162 |
| 2002/0063374 | A1 * | 5/2002 | Takahashi | 271/10.01 |
| 2005/0127593 | A1 * | 6/2005 | Kinsley et al. | 271/162 |
| 2006/0017217 | A1 * | 1/2006 | Maeda | 271/162 |
| 2006/0082044 | A1 * | 4/2006 | Aida | 271/145 |

FOREIGN PATENT DOCUMENTS

| | | |
|---|---|---|
| JP | 05-116784 | 5/1993 |
| JP | 2002-249240 | 9/2002 |
| JP | 2003-081454 | 3/2003 |
| JP | 2003-267560 | 9/2003 |
| JP | 2004-075389 | 3/2004 |
| JP | 2005-047658 | 2/2005 |
| JP | 2006-282354 | 10/2006 |

* cited by examiner

*Primary Examiner* — Prasad Gokhale
(74) *Attorney, Agent, or Firm* — Workman Nydegger

(57) ABSTRACT

A recording medium support device includes the following elements. A feed tray is capable of receiving stacked recording media. A recording medium support is pivotably connected to the feed tray. The support is switchable between a closing position and an opening position by pivoting. An anti-falling section prevents the recording medium support from falling to the closing position by coming into contact with the base of the recording medium support in the opening position.

4 Claims, 15 Drawing Sheets

RECORDING MEDIUM SUPPORT DEVICE AND RECORDING APPARATUS

BACKGROUND

1. Technical Field

The present invention relates to a recording medium support device including a feed tray capable of receiving stacked recording media and a recording medium support that is pivotably connected to the feed tray and is switchable between a closing position and an opening position by pivoting, and a recording apparatus including the recording medium support device. In this specification, the "recording apparatus" conceptually includes a printer, such as a serial printer or a line printer, a facsimile, or a copy machine.

2. Related Art

The structure of a related-art recording medium support device will now be described below using an ink jet printer as an example of the recording apparatus. As disclosed in JP-A-2004-75389 and JP-A-2003-267560, many ink jet printers have a feed tray capable of receiving many stacked sheets of paper, serving as recording media, and a paper support which is connected to the feed tray and serves as a recording medium support. The paper supports are of two types, i.e., the sliding type and the pivoting type. JP-A-2004-75389 and JP-A-2003-267560 each disclose a sliding type paper support.

JP-A-2004-75389 discloses a paper support device in which a pivoting portion has a snap-fit structure. The snap-fit structure has advantages in that the paper support can be reliably held in a used position or an unused position. Disadvantageously, this structure is complicated. Unfortunately, if an external force is applied to the paper support, the paper support may be broken.

JP-A-2003-267560 discloses a structure in which the paper support can be easily switched between a used position and an unused position with a simple operation using the engagement between a recess and a projection and the fit between each groove and the corresponding protruding guide. In these days, the postures of general paper supports when used are tending to be held substantially vertically in order to reduce the size of a printer body. Assuming that the used position of the paper support disclosed in the JP-A-2003-267560 is set such that the posture thereof is held substantially vertically without changing the structure, even when a small external force is applied to the paper support, the paper support is likely to fall forward easily.

Furthermore, in the paper support device disclosed in JP-A-2003-267560, when an operator sets the paper support to the used position by pivoting the paper support, it is difficult for the operator to sense that the paper support reaches the used position. Accordingly, the operator may feel uneasy when operating the paper support. Furthermore, like the paper support device disclosed in JP-A-2004-75389, the paper support disclosed in JP-A-2003-267560 may be broken when receiving an external force.

SUMMARY

An advantage of some aspects of the invention is to provide a recording medium support device that includes a pivoting type recording medium support and has a structure in which the recording medium support is prevented from accidentally falling forward when the posture of the recording medium support in a used position (opening position) is set substantially vertically, and a recording apparatus including the recording medium support device.

Another advantage of some aspect of the invention is to provide a recording medium support device that enables an operator to sense that a recording medium support reaches a used position (opening position) and a recording apparatus including the recording medium support device.

According to a first aspect of the invention, a recording medium support device includes the following elements. A feed tray is capable of receiving stacked recording media. A recording medium support is pivotably connected to the feed tray. The support is switchable between a closing position and an opening position by pivoting. An anti-falling section prevents the recording medium support from falling to the closing position by coming into contact with the base of the recording medium support in the opening position.

According to this aspect, the support device includes the anti-falling section that prevents the recording medium support from falling to the closing position by coming into contact with the base of the recording medium support in the opening position. Accordingly, in the use of the recording medium support of the pivoting type, when the posture of the recording medium support in the opening position (used position) is set substantially vertically, the recording medium support can be prevented from accidentally falling forward.

It is preferable that the anti-falling section include an anti-falling protrusion arranged on the feed tray and a contact face arranged on the recording medium support so as to come into contact with the anti-falling protrusion.

In this case, the recording medium support can be prevented from falling by means of frictional resistance generated by the contact between the anti-falling protrusion and the contact face. Advantageously, the recording medium support in the used position, where the support is set substantially vertically, can be prevented from accidentally falling without using a complicated structure.

The contact face may be formed so that as the recording medium support is pivoted from the opening position to the closing position, the distance between the contact face and the axis of pivot of the recording medium support increases.

In this case, the contact face is formed so that the distance between the contact face and the axis of pivot of the recording medium support increases as the recording medium support is pivoted from the opening position to the closing position. Therefore, as the recording medium support is pivoted from the opening position to the closing position, the friction between the anti-falling protrusion and the contact face gradually increases. Consequently, the recording medium support can be smoothly shifted from the opening position to the closing position because a load is not sharply applied. The ease of operation can be further improved.

The contact face and the anti-falling protrusion may be constructed so as to provide a sense of click to an operator when the contact face crosses the anti-falling protrusion due to relative elastic deformation after an end portion of the contact face comes into contact with the anti-falling protrusion while the recording medium support is switched from the closing position to the opening position.

In this case, the contact face and the anti-falling protrusion are constructed so as to provide a sense of click to the operator when the contact face crosses the anti-falling protrusion due to relative elastic deformation after the end portion of the contact face comes into contact with the anti-falling protrusion while the recording medium support is switched from the closing position to the opening position. Advantageously, the operator can confirm that the recording medium support reliably reaches the opening position on the basis of the sense of click.

This sense of click can be easily realized by constructing the contact face and the anti-falling protrusion so as to have a maximum amount of overlap therebetween when the end portion of the contact face is in contact with the anti-falling protrusion. When the contact face pushes the anti-falling protrusion downward by the maximum amount of overlap, the recording medium support can be allowed to reach the opening position. In this instance, a reaction force is applied from the anti-falling protrusion to the contact face. The reaction force is transmitted as a sense of click to the operator who pivots the recording medium support, so that the operator can recognize that the recording medium support reliably reaches the opening position on the basis of the sense.

The anti-falling protrusion may be arranged on the feed tray through an elastic support member bendable in a direction in which the support member is close to or away from the contact face.

In this case, since the anti-falling protrusion is arranged on the feed tray through the elastic support member bendable in the direction in which the support member is close to or away from the contact face, the position of the anti-falling protrusion relative to the contact face can be varied by the elastic support member supporting the anti-falling protrusion. Therefore, when the contact face crosses the anti-falling protrusion, the recording medium support can be allowed to reach the opening position without being strained.

When the elastic support member, the anti-falling protrusion, and the feed tray are integrally molded such that the feed tray has the support member and the protrusion, they can be easily manufactured. In addition, a plurality of anti-falling protrusions can be easily arranged in the feed tray in the width direction of the feed tray.

According to a second aspect of the invention, a recording medium support device includes the following elements. A feed tray is capable of receiving stacked recording media. A recording medium support is pivotably connected to the feed tray. The support is switchable between a closing position and an opening position by pivoting. An anti-falling section prevents the recording medium support in the opening position from falling to the closing position. The anti-falling section includes an anti-falling protrusion arranged on the feed tray and an opposite face that is arranged on the recording medium support and faces the anti-falling protrusion. The opposite face and the anti-falling protrusion are constructed so as to provide a sense of click to an operator when an end portion of the opposite face crosses the anti-falling protrusion due to relative elastic deformation after coming into contact with the protrusion while the recording medium support is switched from the closing position to the opening position, and are constructed such that the opposite face is not in contact with the anti-falling protrusion when the recording medium support is in the opening position.

In this case, the opposite face of the recording medium support and the anti-falling protrusion provide a sense of click to the operator when the end portion of the opposite face crosses the anti-falling protrusion due to relative elastic deformation after coming into contact with the protrusion while the recording medium support is switched from the closing position to the opening position. When the recording medium support is in the opening position, the opposite face is not in contact with the anti-falling protrusion. Therefore, the anti-falling section temporarily elastically deforms during switching the recording medium support between the closing position and the opening position. Since the anti-falling section does not elastically deform while the recording medium support is in the opening position, creep deformation hardly occurs.

According to a third aspect of the invention, a recording medium support device includes a feed tray, a recording medium support pivotably connected to the feed tray, an auxiliary recording-medium support pivotably connected to the recording medium support, and an anti-falling section. The auxiliary recording-medium support is switchable between a first position in which the auxiliary recording-medium support is superimposed on the recording medium support and a second position in which the auxiliary recording-medium support extends from the recording medium support. The anti-falling section prevents the auxiliary recording-medium support from falling to the first position by coming into contact with the base of the auxiliary recording-medium support in the second position.

In this case, the recording medium support device includes the anti-falling section that prevents the auxiliary recording-medium support from falling to the first position by coming into contact with the base of the auxiliary recording-medium support in the second position (used position). In the use of the auxiliary recording-medium support of the pivoting type, when the posture of the auxiliary recording-medium support in the second position (used position) is set substantially vertically, the auxiliary recording-medium support can be prevented from accidentally falling.

According to a fourth aspect of the invention, a recording apparatus includes the following elements. A feed tray is capable of receiving stacked recording media. A recording medium support is pivotably connected to the feed tray. The support is switchable between a closing position in which the support closes an opening of the feed tray and an opening position in which the support holds the rear surface of the recording medium. The apparatus includes the recording medium support device according to the first aspect.

In this case, the recording apparatus, such as an ink jet printer, can obtain the same advantages as those of the devices according to the above-described aspects. Since the posture of the recording medium support in the used position can be set substantially vertically, the depth of the body of the recording apparatus can be easily reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

A recording medium support device according to an embodiment of the invention and a recording apparatus including the recording medium support device will be described. First, an ink jet printer 100 will now be described as a recording apparatus according to an embodiment of the invention and the schematic entire structure of the printer will be described below with reference to FIG. 1.

Figure 1:
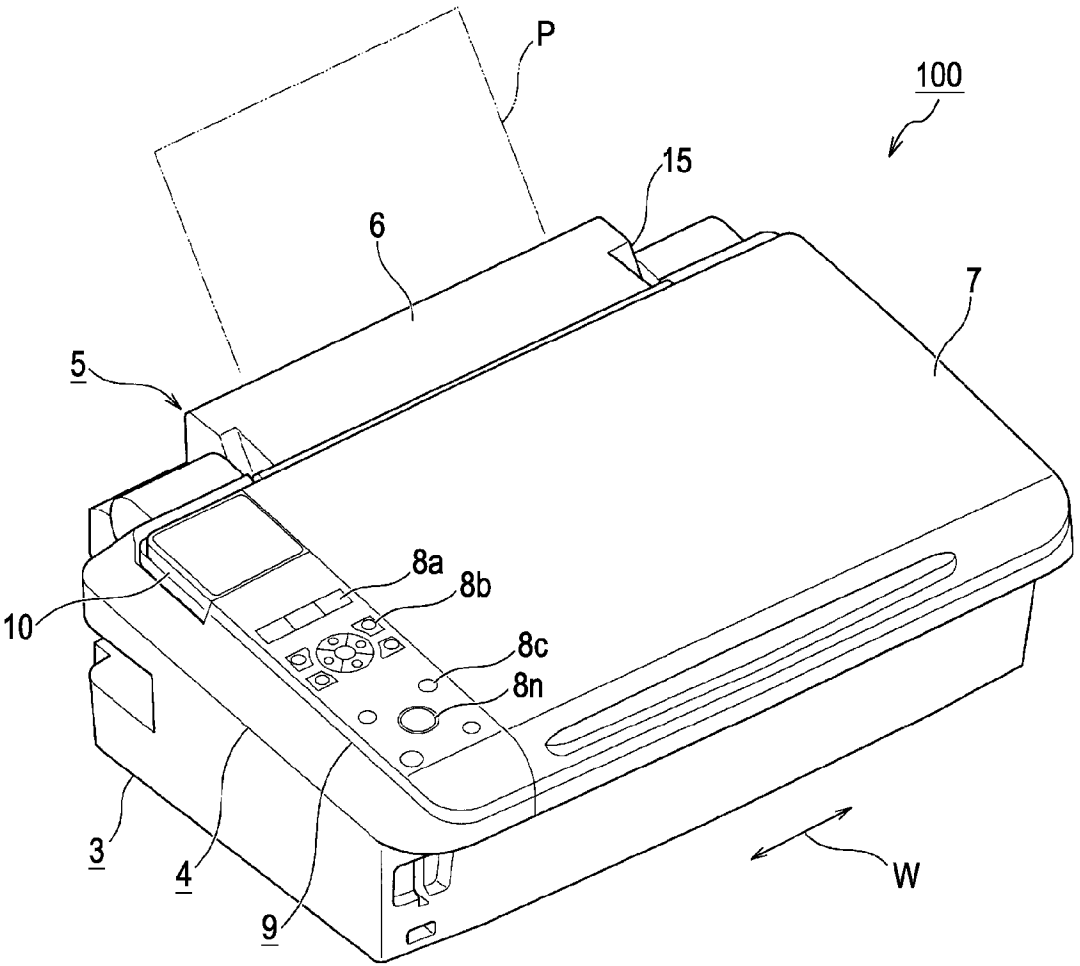
FIG. 1 is a perspective view of an ink jet printer according to an embodiment of the invention.

FIG. 1 is a perspective view of the ink jet printer as viewed from the front upper left side. The ink jet printer 100 is of the medium-sized, general-purpose type for, for example, A4 or smaller recording media (also called "sheets of paper" or "sheets") P. As a matter of course, the embodiment is not limited to this type. The ink jet printer 100 includes a printer body 3, serving as an example of a body of the recording apparatus, and further includes a housing 4 on the printer body 3. The housing 4 has a feed tray 5 at the center of the rear thereof such that the housing 4 and the feed tray 5 are molded in one piece using a known resin material. The feed tray 5 is provided with a detachable, pivoting-type recording medium support (hereinafter, also referred to as "paper support") 6. The paper support 6 is arranged on the feed tray 5 so as to support the rear surface of the bottom sheet of paper P of the sheets stacked on the feed tray 5.

An upper cover 7 that is pivotable upward and downward is arranged on the upper surface of the housing 4. The upper cover 7 includes, for example, an operation panel 9, a liquid crystal display 10, and an opening 11 for the feed tray 5 on the left of the upper cover 7, as shown in FIG. 1. The operation panel 9 has various operation switches 8*a*, 8*b*, 8*c*, . . . , and 8*n*. The liquid crystal display 10 displays various pieces of information, such as paper size, paper type, and paper count.

Before using the ink jet printer 100, an operator pivots the paper support 6 in a closing position upward to set the paper support 6 in an opening position (used position) and inserts a predetermined number of sheets of paper P through the opening 11, which is exposed on the upper surface of the housing 4, such that the sheets are stacked on the feed tray 5. Subsequently, the operator operates the predetermined operation switches 8*a*, 8*b*, 8*c*, . . . , and 8*n* to issue an execution instruction to the recording apparatus. Consequently, while the right and left edges of the sheets of paper P stacked on the feed tray 5 are being guided by edge guides 15, the sheets are automatically fed one by one by pinching between a paper feed roller and a hopper, which are not shown in the diagram, serving as essential components of an automatic feeding mechanism.

The automatically fed sheet of paper P is supplied to transport rollers (not shown) including a pair of nip rollers, i.e., a drive roller and a driven roller for transport, and is then guided to a recording position by the transporting force of the transport rollers. In the recording position, a recording head (not shown) serving as a recording unit, a carriage (not shown) serving as a scanning unit in the scanning direction of the recording head, and a platen (not shown), which supports the rear surface of the sheet of paper P and defines the gap between the sheet and the recording head, are arranged. After recording, the recorded sheet of paper P is ejected to an ejection stacker (not shown) arranged at the end of downstream in the paper transport direction by paper ejecting rollers (not shown) including a pair of nip rollers, i.e., a driving roller and a driven roller for ejection, so that the sheet of paper P is stacked on the stacker.

First Embodiment

A recording medium support device 1 according to a first embodiment of the invention which is provided for the ink jet printer 100 with the above-described structure will be described below with reference to the drawings.

Figure 2:
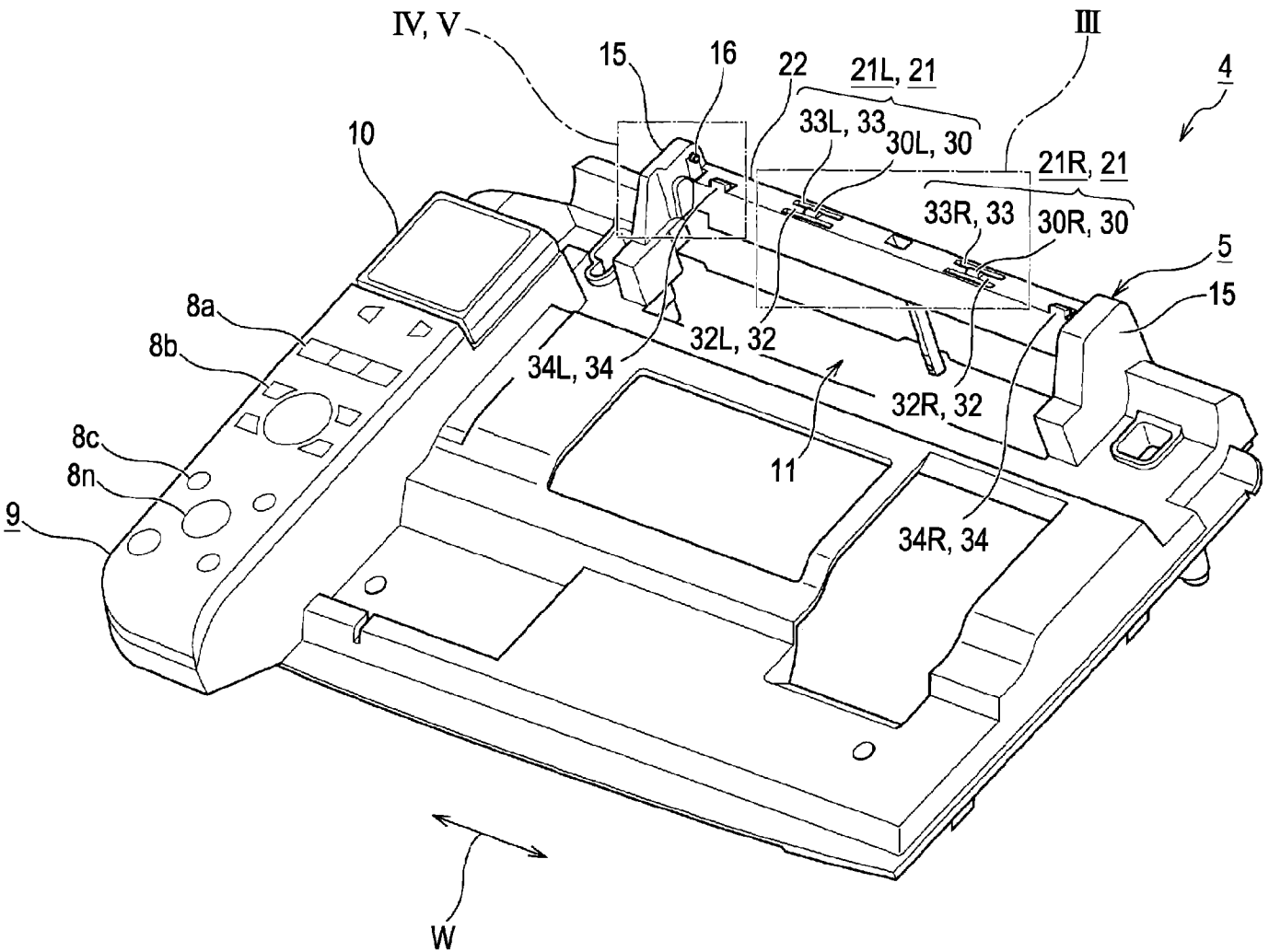
FIG. 2 is a perspective view of a housing in which a paper support is detached from the printer.
Figure 3:
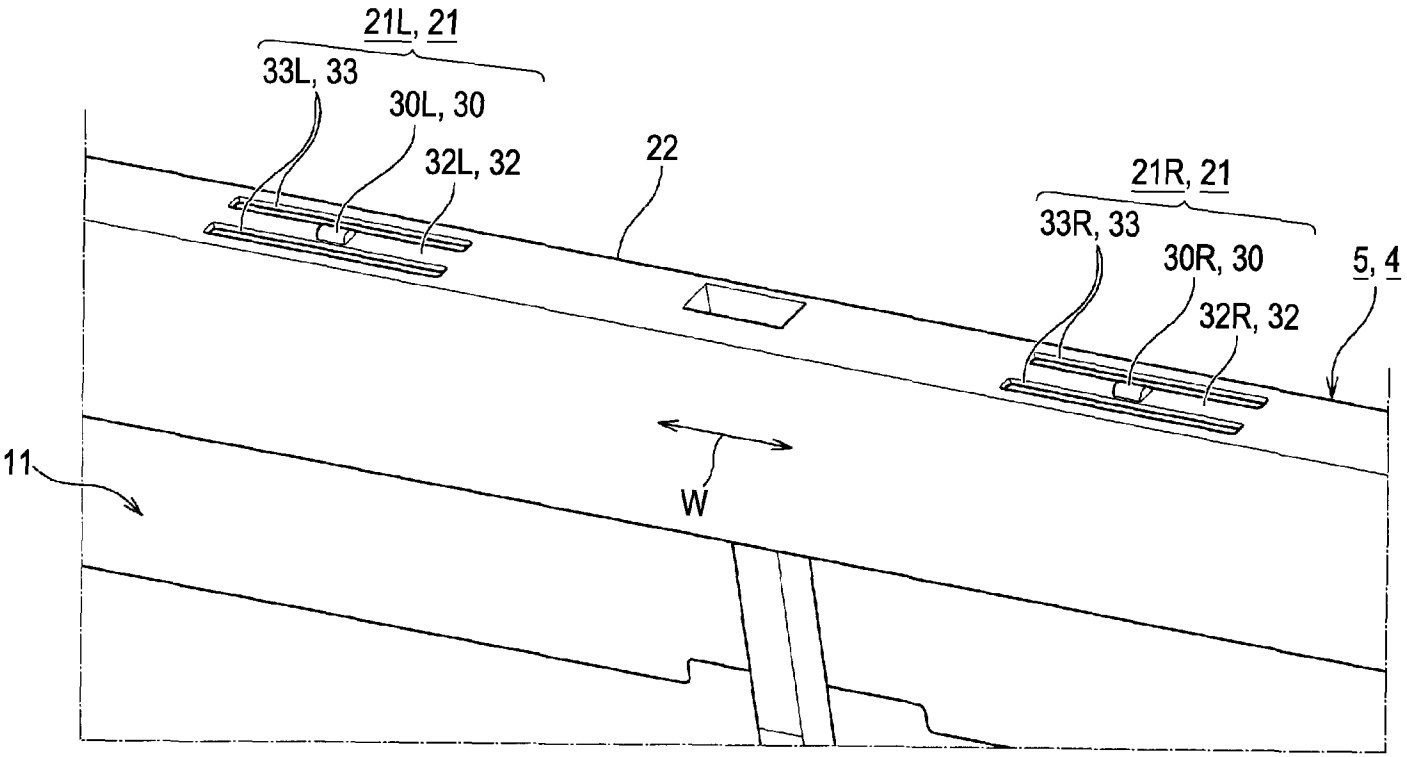
FIG. 3 is an enlarged perspective view of part surrounded by the line III in FIG. 2.
Figure 4:
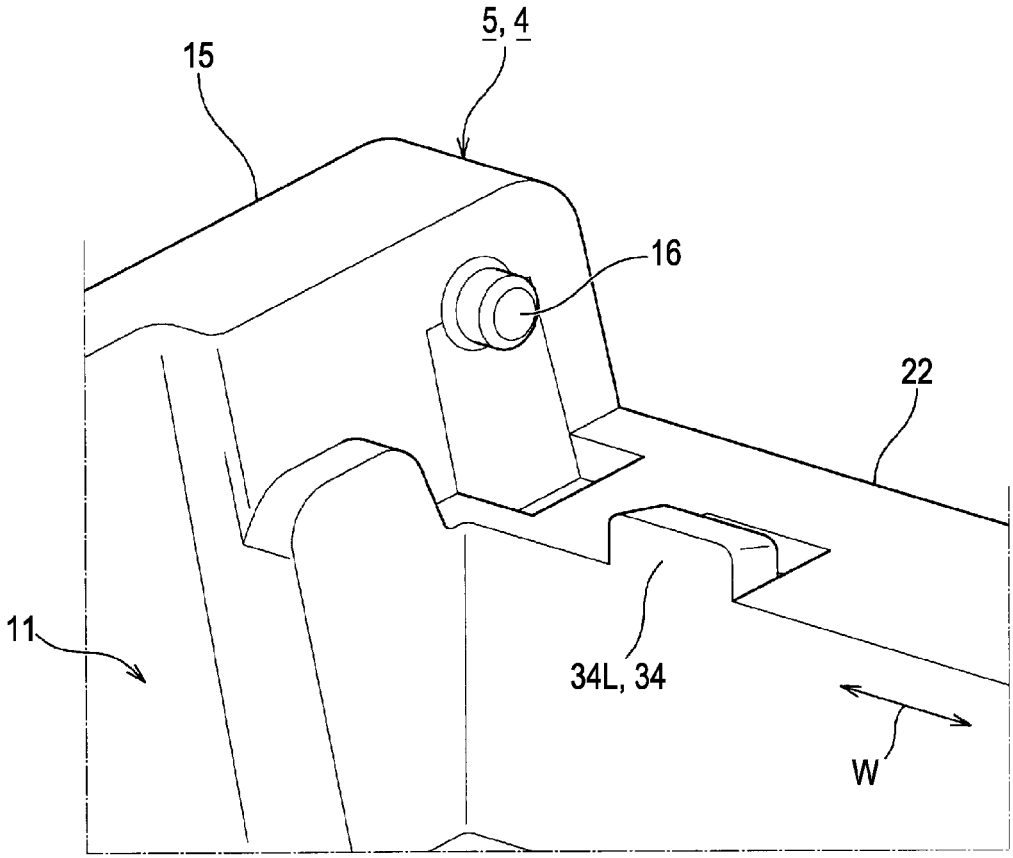
FIG. 4 is an enlarged perspective view of part surrounded by the line IV or V in FIG. 2.
Figure 5:
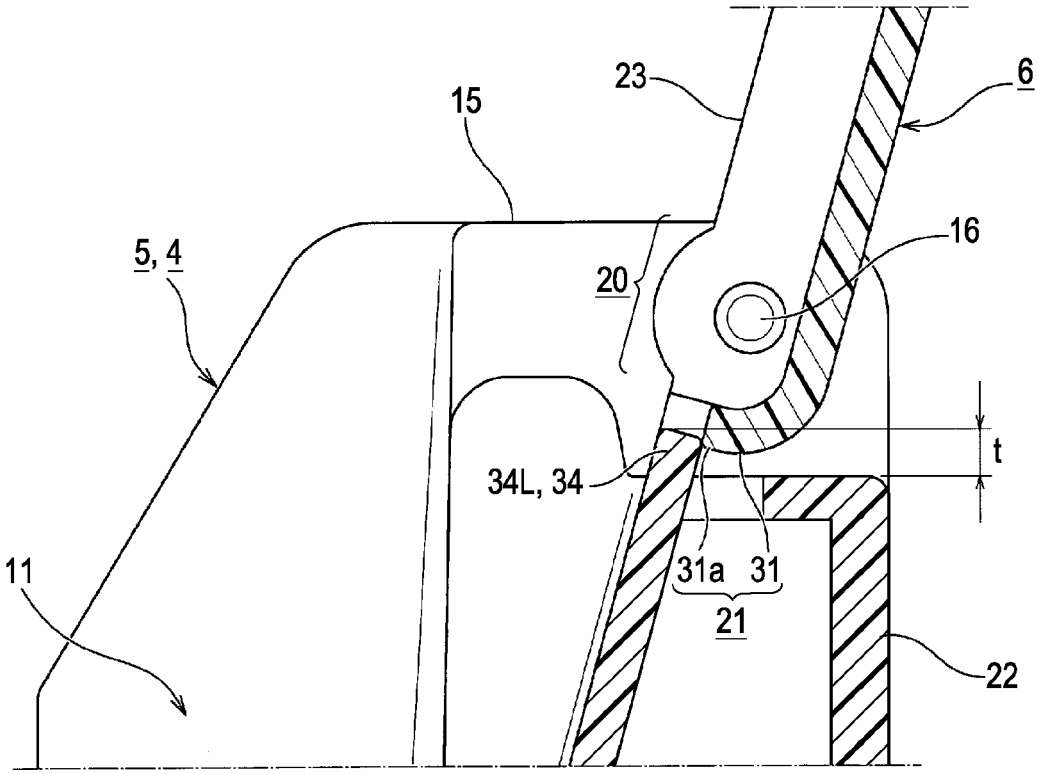
FIG. 5 is a cross-sectional side view of the part shown in FIG. 4 in which the paper support, not shown in FIG. 2, is attached.
Figure 6:
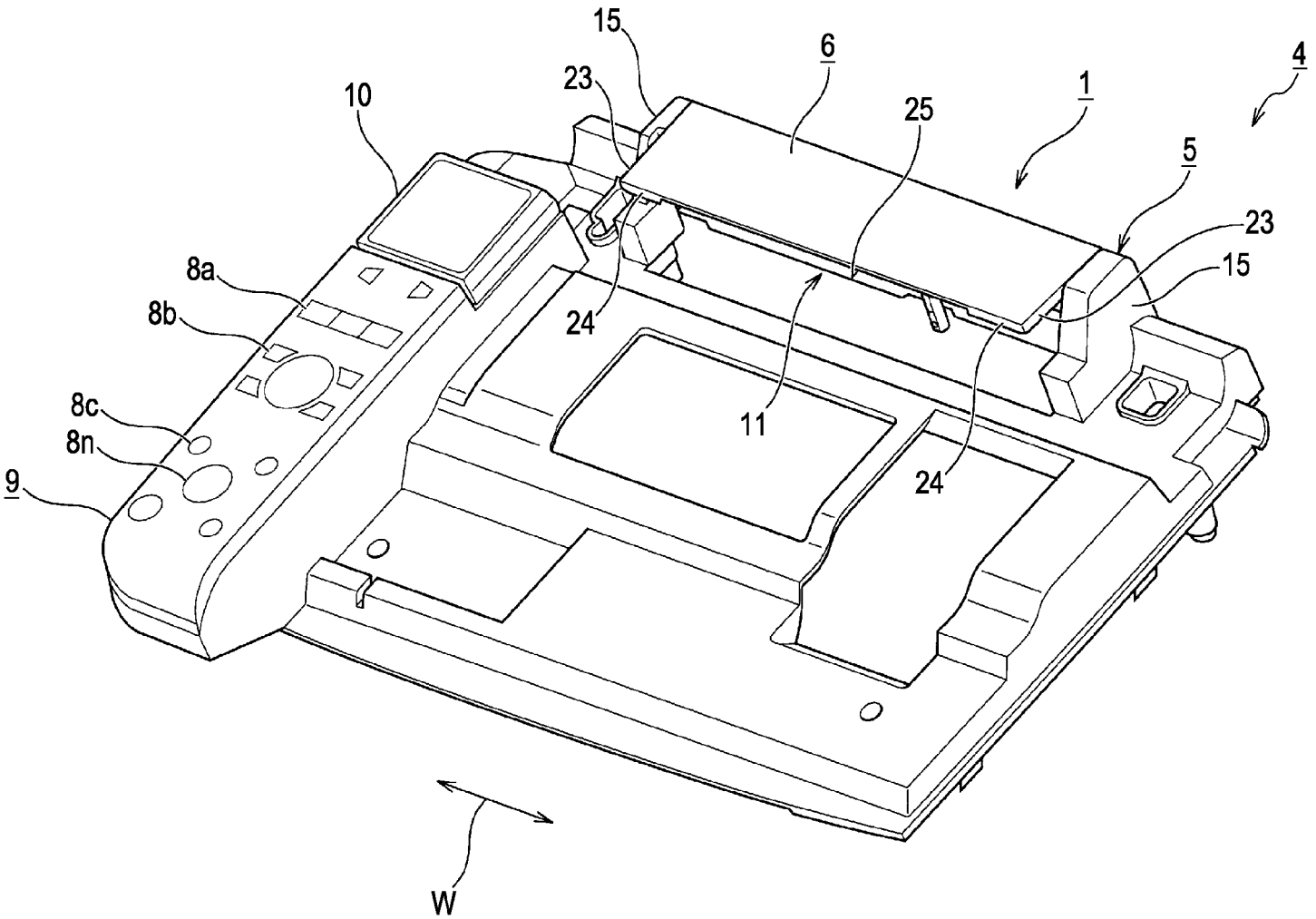
FIG. 6 is a perspective view of the housing with the paper support in a closing position in the printer.
Figure 7:
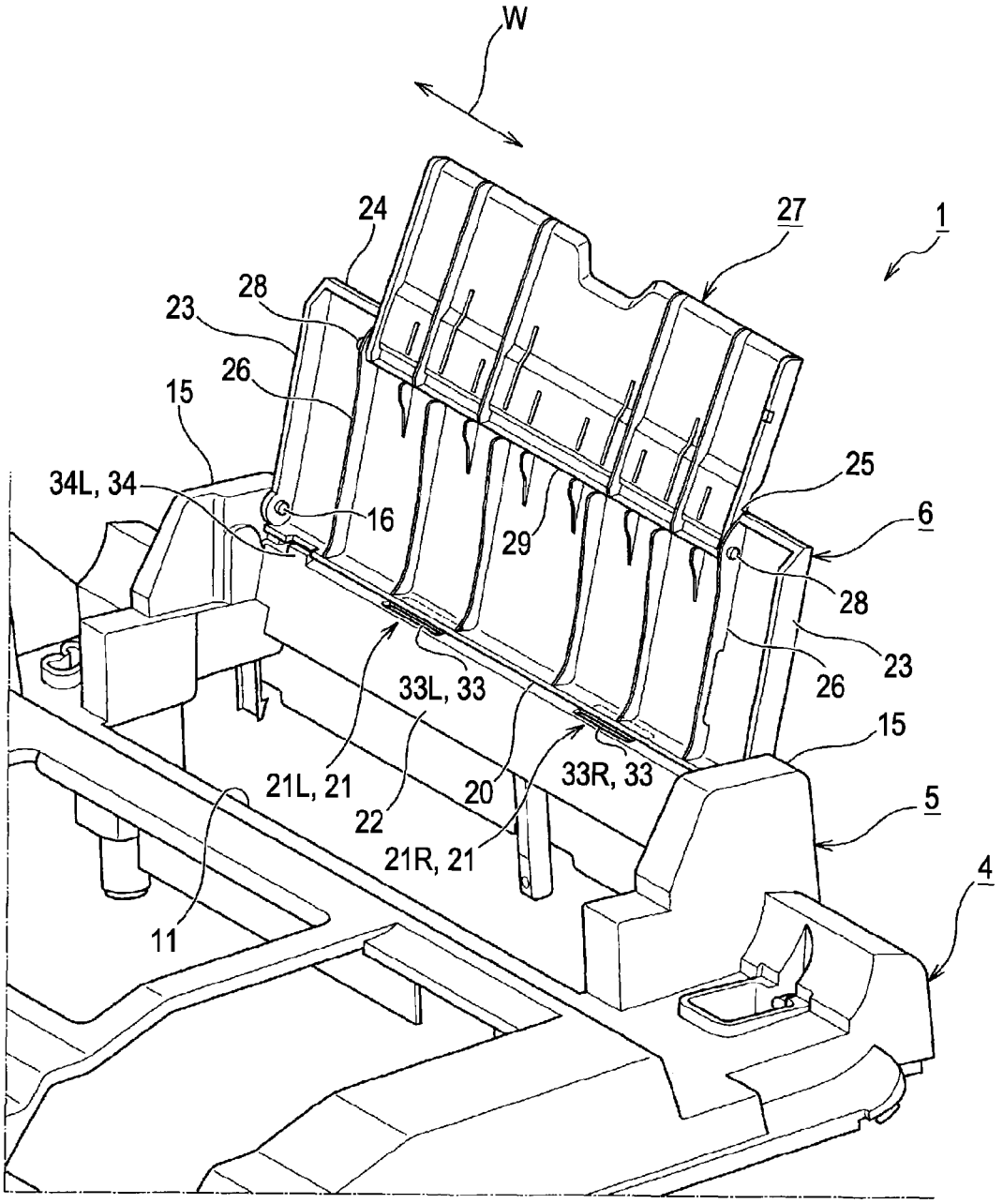
FIG. 7 is a perspective view of a recording medium support device with the paper support in an opening position in the printer.

FIG. 2 is a perspective view of the housing, from which the upper cover and the paper support are detached, the operation panel, and the liquid crystal display as viewed from the front upper right side. FIG. 3 is an enlarged perspective of part surrounded by the line III in FIG. 2. FIG. 4 is an enlarged perspective view of part surrounded by the line IV or V in FIG. 2. FIG. 5 is a cross-sectional side view of the part shown in FIG. 4 and illustrates a state in which the paper support, not shown in FIG. 2, is attached. FIG. 6 is a perspective view of the housing in which the pivoting type paper support is attached to the feed tray, the operation panel, and the liquid crystal display, and illustrates a state in which the paper support is located in the closing position. FIG. 7 is an enlarged perspective view of part in the vicinity of the attached paper support in the opening position (used position).

Figure 8:
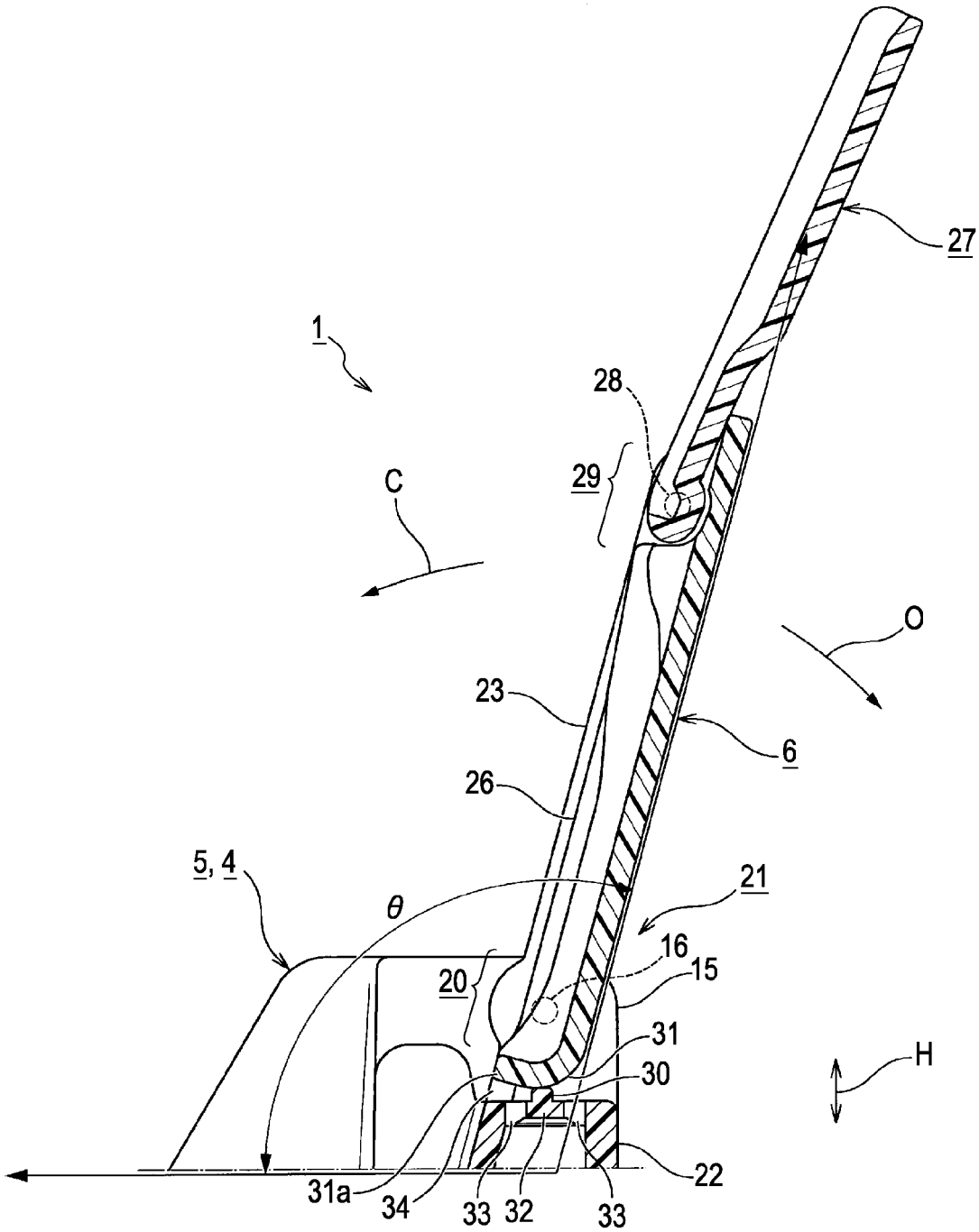
FIG. 8 is a cross-sectional side view of the recording medium support device with the paper support in the opening position in the printer.
Figure 9:
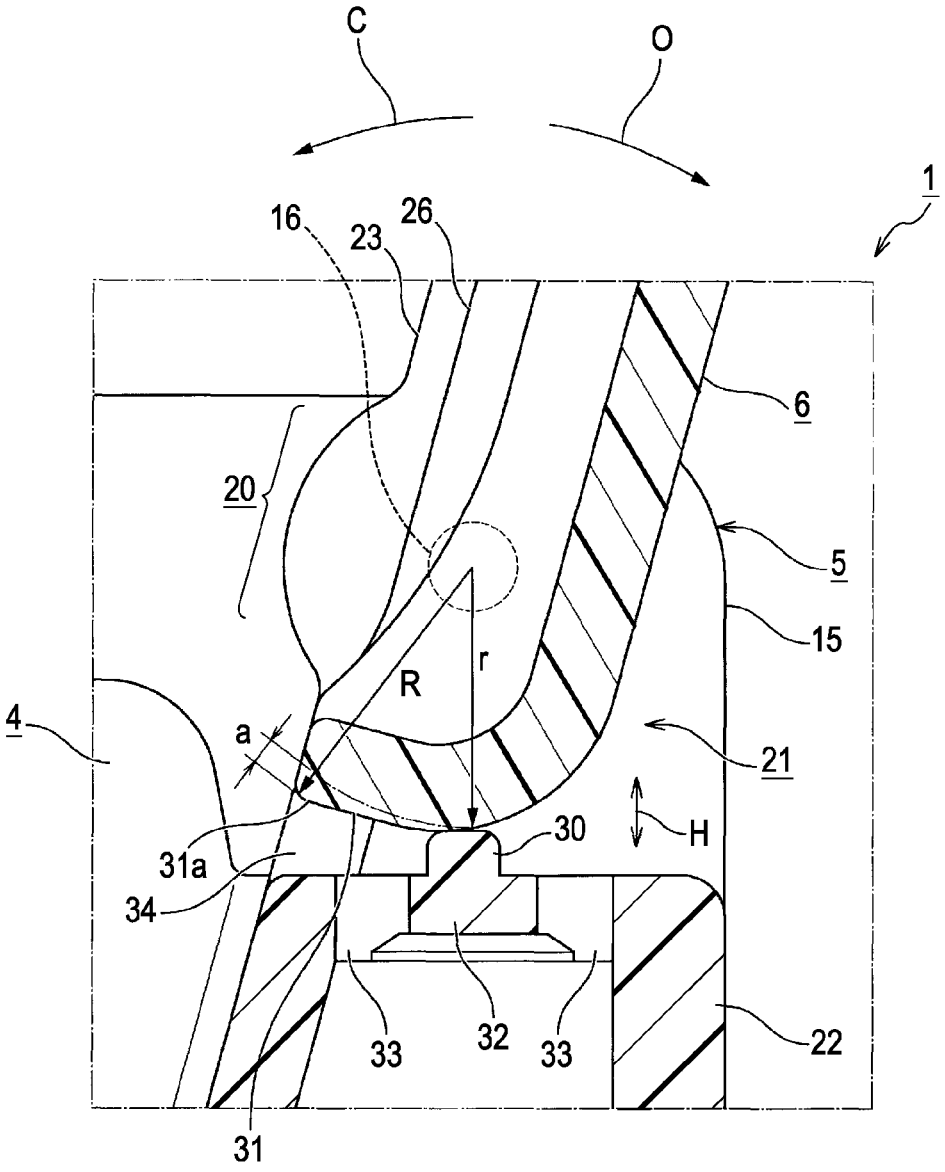
FIG. 9 is a cross-sectional side view of part in the vicinity of an anti-falling mechanism of the recording medium support device in the opening position in the printer.
Figure 10:
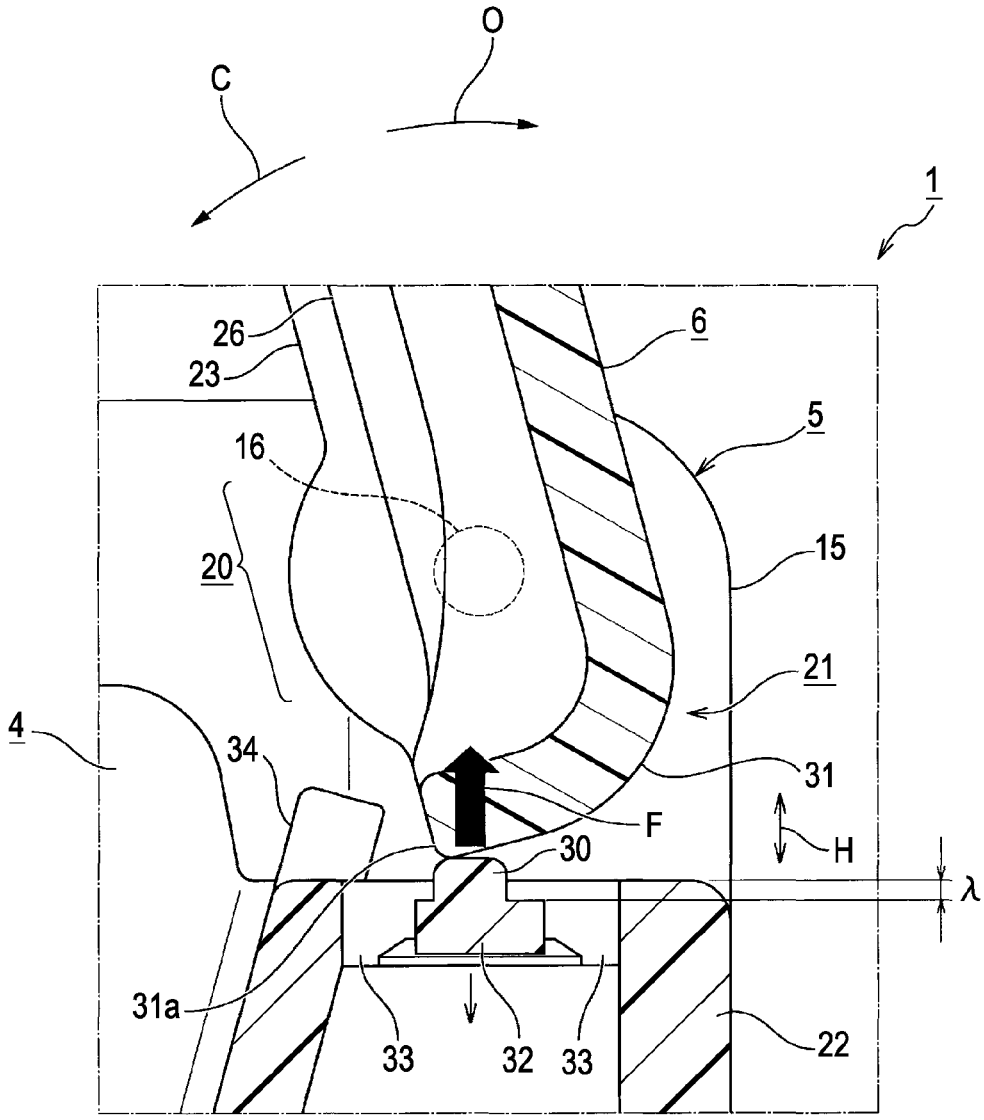
FIG. 10 is a cross-sectional side view of the part, in which an anti-falling protrusion is pushed downward by a maximum amount of overlap, in the printer.
Figure 11:
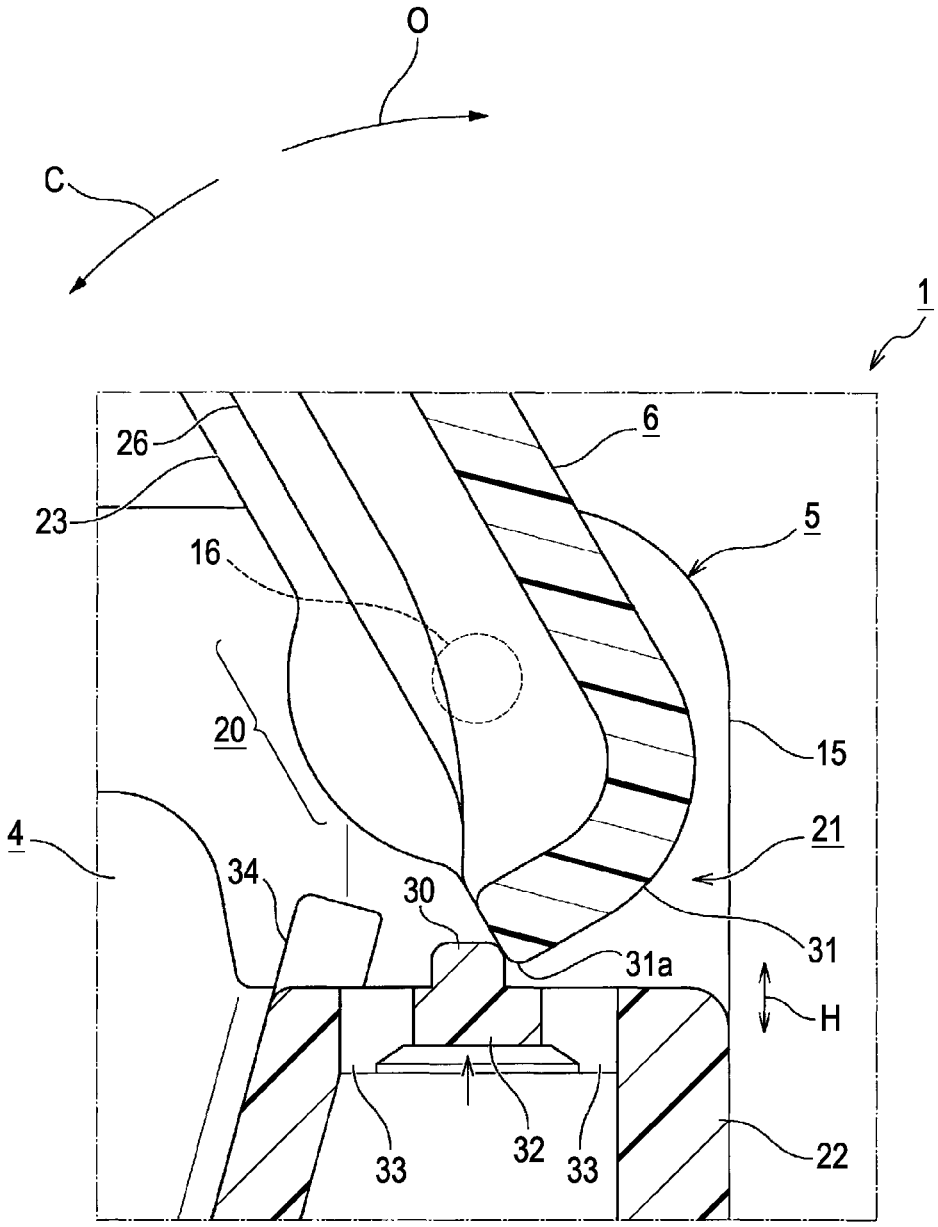
FIG. 11 is a cross-sectional view of the part, in which an end portion of a contact face is in contact with the anti-falling protrusion, in the printer.
Figure 12:
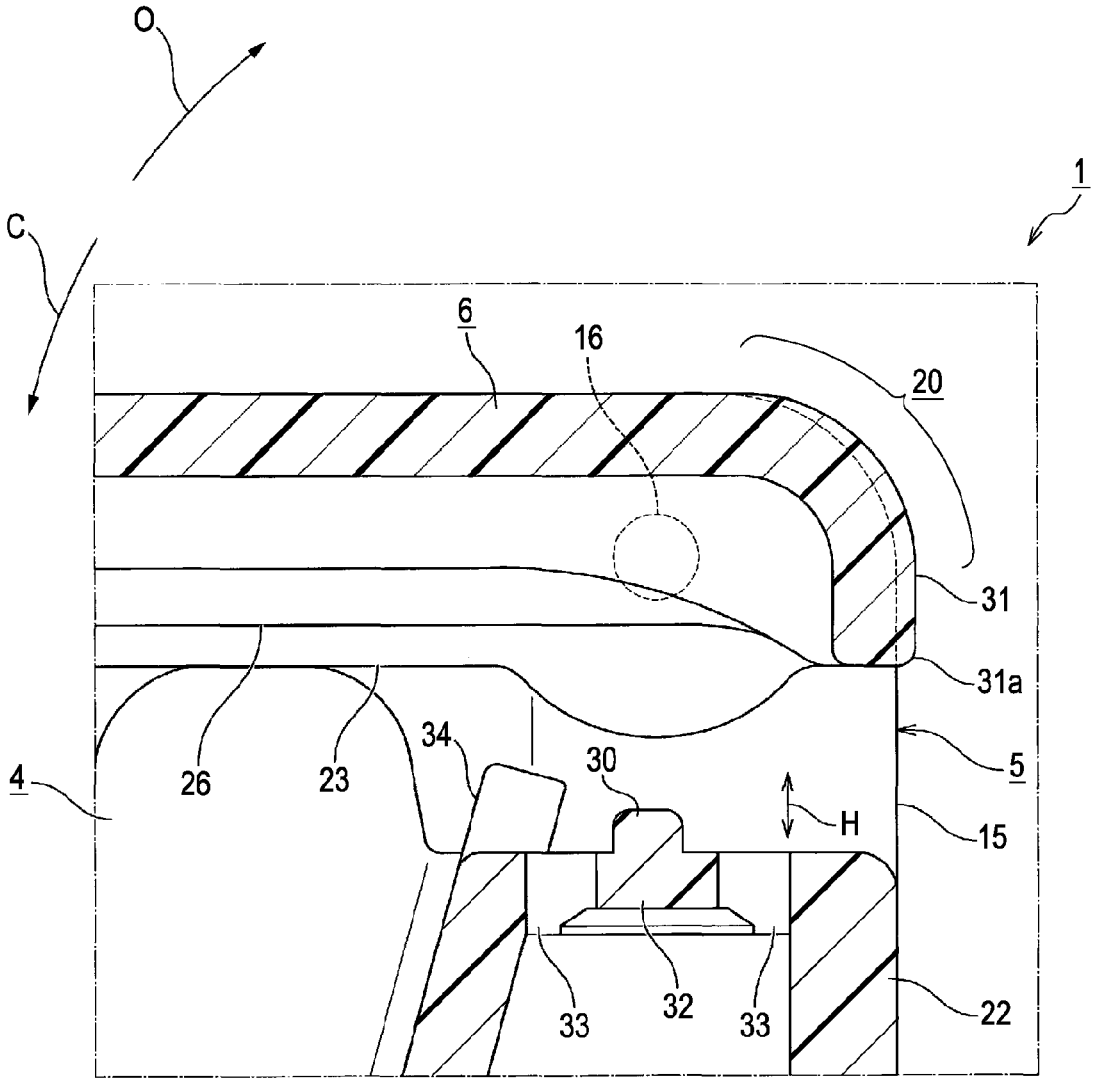
FIG. 12 is a cross-sectional side view of part in the vicinity of the anti-falling mechanism when the paper support is in the closing position in the printer.

FIG. 8 is a cross-sectional side view of the recording medium support device in which the paper support is in the opening position. FIG. 9 is an enlarged, cross-sectional side view of part in the vicinity of an anti-falling mechanism in FIG. 8. FIG. 10 is a cross-sectional side view of the part in the vicinity of the anti-falling mechanism in which an anti-falling protrusion is pushed downward by a maximum amount of overlap. FIG. 11 is a cross-sectional side view of the part in the vicinity of the anti-falling mechanism when an end portion of a contact face comes into contact with the anti-falling protrusion. FIG. 12 is an enlarged, cross-sectional side view of the part in the vicinity of the anti-falling mechanism in which the paper support is in the closing position.

The recording medium support device 1 according to the first embodiment of the invention fundamentally includes the feed tray 5, the paper support 6, and anti-falling mechanisms 21, which will be described in detail later. The feed tray 5 is integrated with the housing 4 as described above. In the feed tray 5, the right and left edge guides 15, 15 have rotation shafts 16, 16, respectively, such that the rotation shaft 16 extends inward from upper part of the inner side surface of each edge guide 15 adjacent to the back surface thereof. A long support frame 22 having a substantially U-shaped cross section is arranged horizontally between the inner side surfaces of the right and left edge guides 15, 15 adjacent to the back surfaces thereof.

Referring to FIG. 7, the paper support 6 is a rectangular flat member detachable from the feed tray 5. The paper support 6 includes right and left side plates 23, 23 on opposite sides of a first surface (or the upper surface in the closing position as shown in FIG. 6). The side plates 23, 23 each have an engagement hole (not shown) to be engaged with the corresponding rotation shaft 16 in the feed tray 5. The paper support 6 is attached to the feed tray 5 so as to be pivotable about the rotation shafts 16, 16. The paper support 6 is configured to be switchable between the closing position where the paper support 6 closes the opening 11 of the feed tray 5, as shown in FIGS. 6 and 12, and the opening position (used position) where the paper support 6 supports the rear surface of the bottom sheet of paper P stacked on the feed tray 5, as shown in FIGS. 7 to 9.

The angle of inclination (hereinafter, "inclination angle") θ of the paper support 6 in the opening position is set to approximately 105° in this embodiment. Accordingly, the paper support 6 is substantially vertically disposed, that is, the inclination angle θ of the paper support 6 is closer to a right angle than that in the related-art recording medium support device.

The paper support 6 includes a front plate 24. As shown in FIG. 7, the front plate 24 has a U-shaped recess at the center thereof. The paper support 6 further includes reinforcing ribs 26. Each of the reinforcing ribs 26, serving as right and left side plates for the recess 25, has an engagement hole (not shown) in a position opposite to a rotation shaft 28 of an auxiliary paper support 27 so that the engagement holes of the reinforcing ribs 26 are engaged with the respective rotation shafts 28, 28. The auxiliary paper support 27, serving as an auxiliary recording-medium support, is a flat member detachable from the paper support 6 and is smaller than the paper support 6. The base, indicated at 29, of the auxiliary paper support 27 is fitted into the recess 25 of the front plate 24 in the paper support 6. The auxiliary paper support 27 is connected to the paper support 6 such that the support 27 is pivotable about the rotation shafts 28, 28. The auxiliary paper support 27 is configured to be switchable between a first position and a second position (used position). In the first position, the auxiliary paper support 27 is superimposed on a second surface of the paper support 6, the second surface being the opposite side of the paper support 6 from the first surface. In the second position, the auxiliary paper support 27 extends upward from the paper support 6 so as to support the rear surface of the bottom sheet of paper P, as shown in FIGS. 7 and 8.

Referring to FIG. 8, when being in contact with the base, indicated at 20, of the paper support 6 in the opening position, each anti-falling mechanism 21 prevents the paper support 6 from falling to the closing position. Specifically, the anti-falling mechanism 21 is composed of an anti-falling protrusion 30 arranged on the feed tray 5 and a contact face 31 that is come into contact with the anti-falling protrusion 30 to provide frictional engagement therebetween.

Referring to FIG. 3, each anti-falling protrusion 30 has, for example, a semicircular columnar shape. The anti-falling protrusion 30 is integrated with the feed tray 5 through an elastic support member 32 which is bendable in a direction H (see FIG. 8) in which the elastic support member 32 is close to or away from the contact face 31.

The support frame 22 has two pairs of slits 33, 33 on the upper surface thereof such that the slits 33 extend in a direction W along the width of the printer, the slits of each pair sandwich a narrow region extending in the direction W, and the two pairs of slits are arranged at a predetermined distance from each other. The narrow region between each pair of slits 33, 33 corresponds to the elastic support member 32. Each elastic support member 32 has the anti-falling protrusion 30 at substantially the center of the upper surface thereof. The anti-falling protrusions 30, the elastic support members 32, and other parts of the support frame 22 are integrally molded. In this embodiment, as shown in FIGS. 2 and 3, two combinations of the anti-falling protrusion 30 and the elastic support member 32 are arranged on the upper surface along the center line thereof such that the combinations are symmetric with respect to the middle of the support frame 22 in the direction W. The anti-falling protrusions 30, the elastic support members 32, the slits 33, and the anti-falling mechanisms 21 are distinguished such that the anti-falling protrusion 30L, the elastic support member 32L, the slits 33L, and the anti-falling mechanism 21L are disposed on the left of the support frame 22 in FIGS. 2 and 3 and the anti-falling protrusion 30R, the elastic support member 32R, the slits 33R, and the anti-falling mechanism 21R are disposed on the right of the support frame 22.

The contact face 31 extends along, for example, the whole of the width of the paper support 6 in the direction W. Specifically, the outer surface of the base 20 of the paper support 6 is formed so as to be smoothly curved, as shown in FIG. 9. The contact face 31 is formed such that as the paper support 6 pivots from the opening position to the closing position, the distance of the contact face 31 from the axis of rotation (the rotation shaft 16) of the paper support 6 increases. In other words, the contact face 31 is configured so that the curvature of the contact face 31 gradually increases as the paper support 6 in the opening position is rotated in a direction C toward the closing position.

Referring to FIG. 9, reference symbol "r" denotes a radius of minimum curvature (hereinafter, "minimum curvature radius") of the contact face 31, reference symbol "R" denotes a radius of maximum curvature (hereinafter, "maximum curvature radius") of the contact face 31, and reference symbol "a" indicates the difference between the minimum curvature radius r and the maximum curvature radius R. The difference a therebetween corresponds to a maximum amount of overlap between the contact face 31 and the anti-falling protrusion 30.

The contact face 31 and each anti-falling protrusion 30 are constructed so as to provide a sense of click to the operator when an end portion 31*a* of the contact face 31 crosses the anti-falling protrusion 30 due to relative elastic deformation after coming into contact with the anti-falling protrusion 30 while the paper support 6 is switched from the closing position to the opening position. In other words, the maximum amount a of overlap between the contact face 31 and the anti-falling protrusion 30 is set to a dimension in which the end portion 31*a* of the contact face 31 comes into contact with the anti-falling protrusion 30 (see FIG. 11) and crosses the anti-falling protrusion 30. In addition, the maximum amount a of overlap therebetween is set so as to provide a good sense of click to the operator when the end portion 31*a* of the contact face 31 crosses the anti-falling protrusion 30 to set the paper support 6 in the opening position.

When the end portion 31*a* of the contact face 31 moves on the anti-falling protrusion 30 as shown in FIG. 10, a reaction force, indicated by an arrow F in FIG. 10, applied to the contact face 31 from the anti-falling protrusion 30 reaches a maximum value. At that time, the amount of bending of the elastic support member 32 reaches a maximum value λ.

Furthermore, in the embodiment, two paper support stoppers 34 symmetrically extend from the upper surface of the support frame 22 such that a paper support stopper 34L is arranged on the left of the upper surface and a paper support stopper 34R is disposed on the right thereof, as shown in FIGS. 2, 4, and 5. Those paper support stoppers 34L, 34R also function as stoppers that determine the inclination angle θ of the paper support 6 in the opening position.

The height t of each of the paper support stoppers 34L, 34R is set as follows: when a large external force is applied to the paper support 6 in the opening position (so as to push the paper support 6 backward), the paper support 6 is pivotable without being detached from the rotation shafts 16, 16 in the feed tray 5 such that the end portion 31*a* of the base 20 of the paper support 6 crosses the paper support stoppers 34L, 34R having the height t. Consequently, if the large external force is applied to the paper support 6, breakage of the base 20 of the paper support 6 and the rotation shafts 16, 16 in the feed tray 5 can be prevented.

Even when the paper support 6 pivots such that the end portion 31*a* of the paper support 6 crosses the paper support stoppers 34L, 34R, the paper support 6 is not detached from the rotation shafts 16, 16 as described above. Accordingly, the paper support 6 can be returned to the original opening position by rotating the paper support 6 in the opposite direction (i.e., the direction to the closing position). In the embodiment, the height t of each of the paper support stoppers 34L, 34R is set to, for example, 2.5 mm.

Actions of the recording medium support device 1 with the above-described structure according to the first embodiment will now be described with reference to FIGS. 7 to 12 in the following order of:

1. Shift to Closing Position; and
2. Shift to Opening Position.

1. Shift to Closing Position (see FIGS. 7 to 12)

A case where the paper support 6 in the opening position shown in FIGS. 8 and 9 is shifted to the closing position shown in FIG. 12 by rotating the paper support 6 counterclockwise, i.e., in the closing direction C will now be described. In a case where the sheets of paper P are stacked on the feed tray 5, the operator removes the sheets, tilts the auxiliary paper support 27 forward, and superimposes the support 27 on the paper support 6 to set the auxiliary paper support 27 in the first position. In this state, the operator gradually pulls the paper support 6 while holding a free end of the paper support 6.

The reaction force F applied from each anti-falling protrusion 30 to the contact face 31 gradually increases at the end portion 31*a* of the contact face 31. When the paper support 6 is located as shown in FIG. 10, the reaction force F reaches the maximum value. At that time, the amount of bending of each elastic support member 32 reaches the maximum value, i.e., the maximum amount λ of bending. Consequently, each anti-falling protrusion 30 moves downward by the maximum amount λ of bending due to the bending deformation of the corresponding elastic support member 32, thus permitting the end portion 31*a* of the contact face 31 to pass on the anti-falling protrusion 30.

When the operator further rotates the paper support 6 counterclockwise, the end portion 31*a* of the contact face 31 moves away from the upper surface of each anti-falling protrusion 30, so that the end portion 31*a* is located as shown in FIG. 11. When the paper support 6 comes to this state, the anti-falling protrusion 30 is released from the pressure from the contact face 31. Consequently, the anti-falling protrusion 30 quickly rises to the original position due to the reaction force F produced by the return of the bending elastic support member 32 to the original horizontal position. A vibration caused by this quick rising is transmitted as a sense of click to the hand of the operator, so that the operator can grasp that the base 20 of the paper support 6 is moved away from the anti-falling protrusions 30. When the operator further rotates the paper support 6 counterclockwise, the paper support 6 is tilted horizontally, i.e., located in the closing position, thus closing the opening 11 of the feed tray 5.

2. Shift to Opening Position (see FIGS. 7 to 12)

A case where the paper support 6 in the closing position shown in FIG. 12 is rotated to a direction O to the opening position (hereinafter, "opening direction O"), i.e., clockwise in FIG. 12 to shift the paper support 6 to the opening position (used position) as shown in FIGS. 8 and 9 will now be described. In this case, the operator holds the free end (in the vicinity of the recess 25) of the paper support 6 with his or her fingers and rotates the paper support 6 upward. After that, when the end portion 31*a* of the contact face 31 comes into contact with each anti-falling protrusion 30 as shown in FIG. 11, the load instantaneously increases. Then, the end portion 31*a* of the contact face 31 runs on the anti-falling protrusion 30. When the end portion 31*a* of the contact face 31 comes into contact with the upper surface of the anti-falling protrusion 30 as shown in FIG. 10, the reaction force F applied from the anti-falling protrusion 30 to the contact face 31 reaches the maximum value, so that the load applied to the paper support 6 reaches a maximum value. The reaction force F as the maximum load is transmitted to the operator's hand as a sense of click during a change from the state in FIG. 11 to that in FIG. 10. Consequently, the operator can grasp that the base 20 of the paper support 6 reaches the anti-falling protrusion 30.

When the paper support 6 located as shown in FIG. 10 is further rotated clockwise, the end portion 31*a* of the contact face 31 moves on the upper surface of each anti-falling protrusion 30, so that the position of the contact face 31 relative to the anti-falling protrusion 30 provides the minimum curvature radius r, as shown in FIG. 9. Such a series of load fluctuations provides a sense of click to the operator, so that the operator can feel that the paper support 6 is located in the opening position. Even when a small external force in the closing direction C is applied to the paper support 6 in the opening position shown in FIG. 9 due to, for example, vibrations, the retention (or friction) between the contact face 31 and each anti-falling protrusion 30 for holding the paper support 6 in the opening position prevents the paper support 6 from accidentally falling in the closing direction C.

Second Embodiment

The recording medium support device 1 according to the first embodiment of the invention and the recording apparatus (ink jet printer) 100 including the recording medium support device 1 fundamentally have the above-described structures. It is to be understood that modifications and variations may be made without departing from the spirit and scope of the invention.

Figure 13:
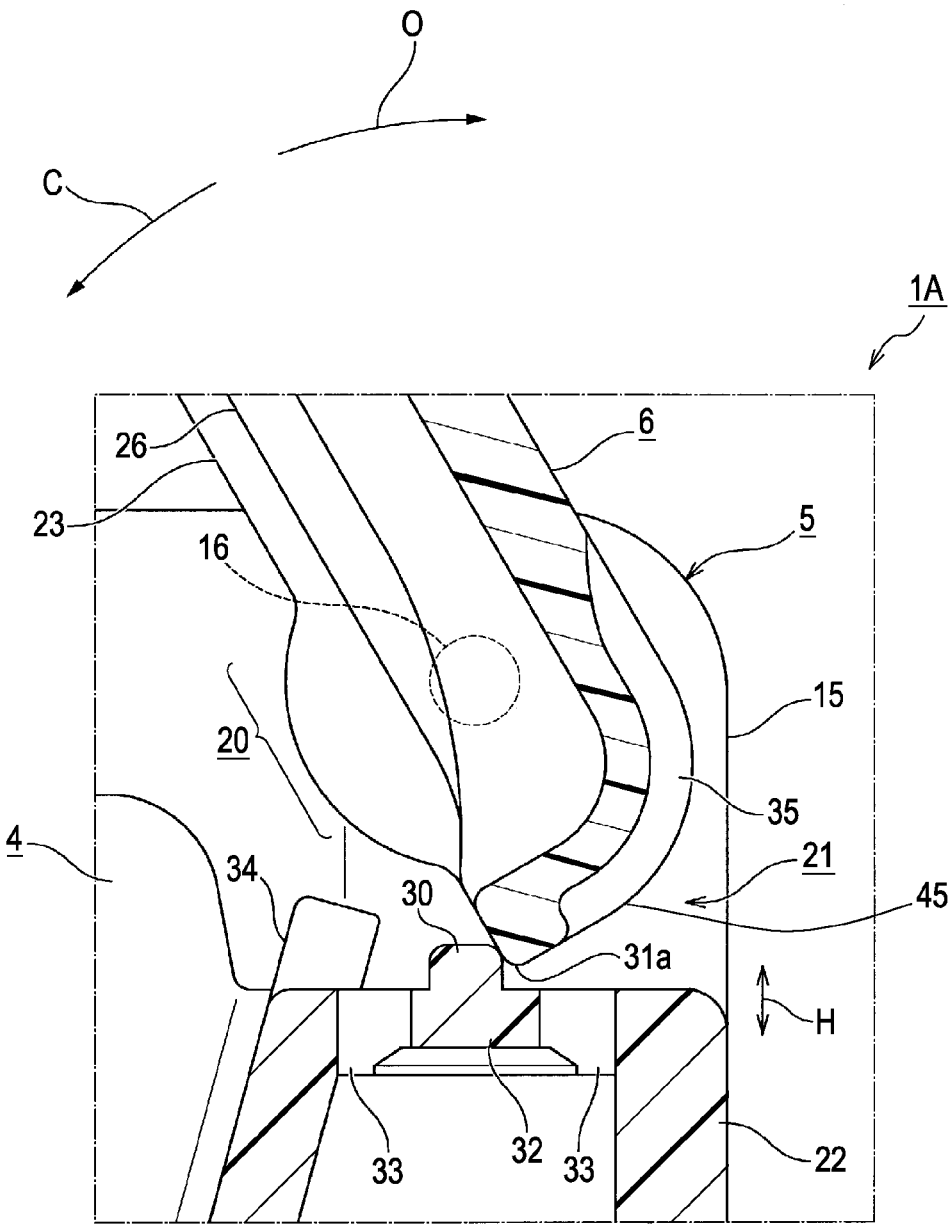
FIG. 13 is a cross-sectional side view of a recording medium support device according to another embodiment.

FIG. 13 is a cross-sectional side view of a recording medium support device according to a second embodiment of the invention, the cross section of a contact face being different from that in the first embodiment. The basic structure of the recording medium support device, indicated at 1A, according to the second embodiment is substantially the same as that of the recording medium support device 1 shown in FIGS. 1 to 12. Each anti-falling mechanism 21 includes an anti-falling protrusion 30 arranged on a feed tray 5 and an opposite face 45 that is included in a paper support 6 and faces the anti-falling protrusion 30. While a paper support 6 is shifted from the closing position to the opening position, when an end portion 31*a* of the opposite face 45 crosses the anti-falling protrusions 30 due to relative elastic deformation after coming into contact with the protrusions 30, the opposite face 45 and the anti-falling protrusions 30 provide a sense of click to the operator. In the opening position, the opposite face 45 is not in contact with the anti-falling protrusions 30.

In other words, only the structure of the contact face 31 in the second embodiment is different from that in the first embodiment. In the base, indicated at 20, of the paper support 6, a contact face 31 similar to that in the first embodiment is arranged in the end portion 31*a*. The outer surface of the base 20 excluding the contact face 31 has a recess 35 so that the base 20 is not come into contact with the anti-falling protrusions 30.

According to the second embodiment, each anti-falling mechanism 21 is elastically deformed temporarily during switching the paper support 6 between the closing position and the opening position. In the opening position, the anti-falling mechanism 21 is not elastically deformed. Advantageously, a problem, for example, creep deformation hardly occurs. In the use of the above-described structure, the above-described sense of click can be provided during shifting the paper support 6 to the opening position.

Third Embodiment

Figure 14:
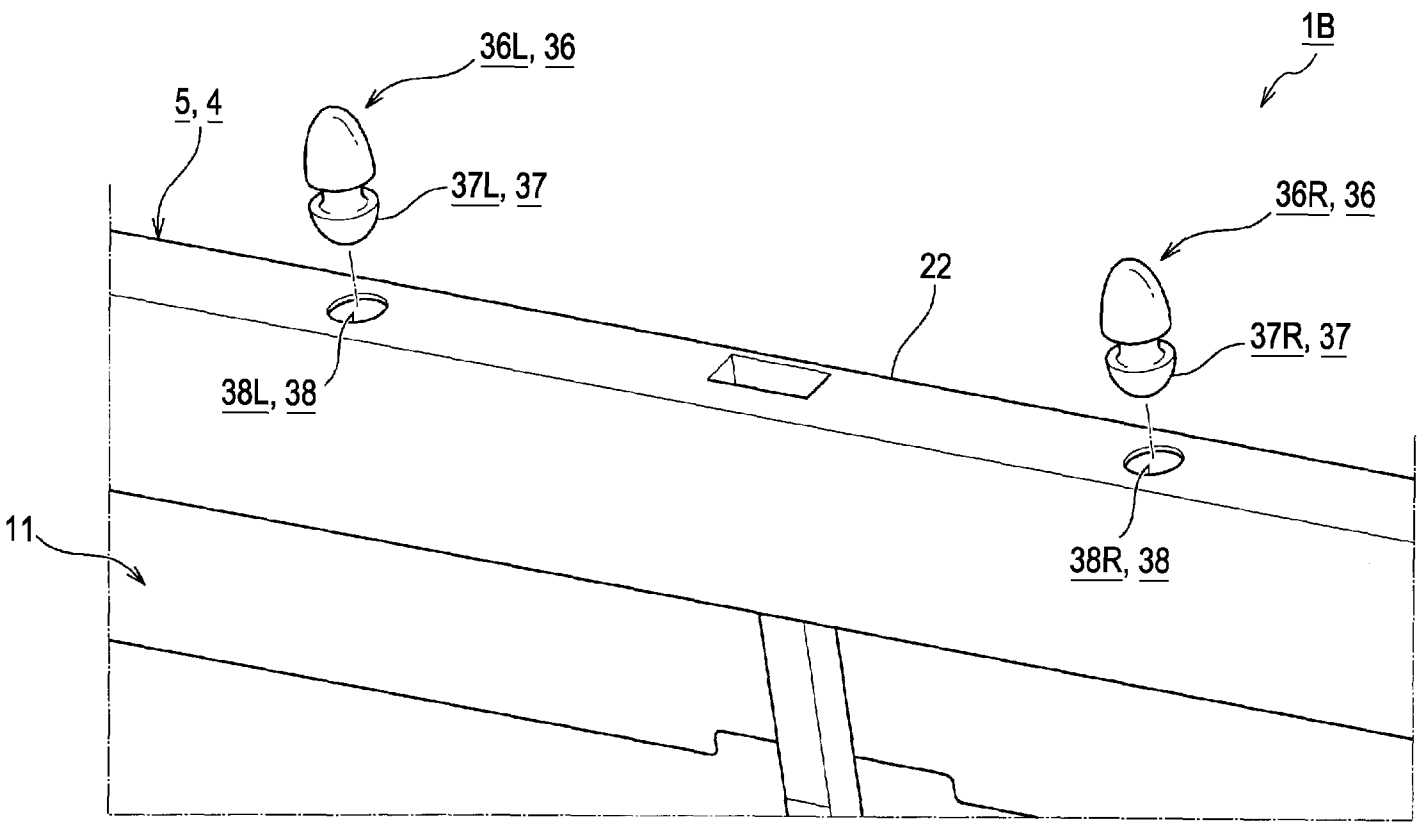
FIG. 14 is a cross-sectional side view of a recording medium support device according to another embodiment.

FIG. 14 is a cross-sectional side view of a recording medium support device according to a third embodiment of the invention, the device including anti-falling protrusions and elastic support members, the protrusions and support members having the structures different from those of the corresponding components in the first embodiment. In the recording medium support device, indicated at 1B, according to the third embodiment, each anti-falling protrusion 36 is constructed separately from a support frame 22 so that the anti-falling protrusion 36 is movable close to or away from a contact face 31 in the direction H using the elastic deformation of the anti-falling protrusion 36 itself. Specifically, each anti-falling protrusion 36 is made of, for example, a rubber-like elastic material. The anti-falling protrusion 36 has an engaging portion 37 in lower part thereof. The engaging portion 37 is inserted into an engagement hole 38 arranged on the upper surface of the support frame 22, thus attaching the anti-falling protrusion 36 to the support frame 22.

In the use of the recording medium support device with the above-described structure, the same advantages as those of the first or second embodiment can be obtained. The anti-falling protrusions 36, the engaging portions 37, and the engagement holes 38 are distinguished such that the anti-falling protrusion 36L, the engaging portion 37L, and the engagement hole 38L are disposed on the left of the device in FIG. 14, and the anti-falling protrusion 36R, the engaging portion 37R, and the engagement hole 38R are disposed on the right thereof.

Fourth Embodiment

Figure 15:
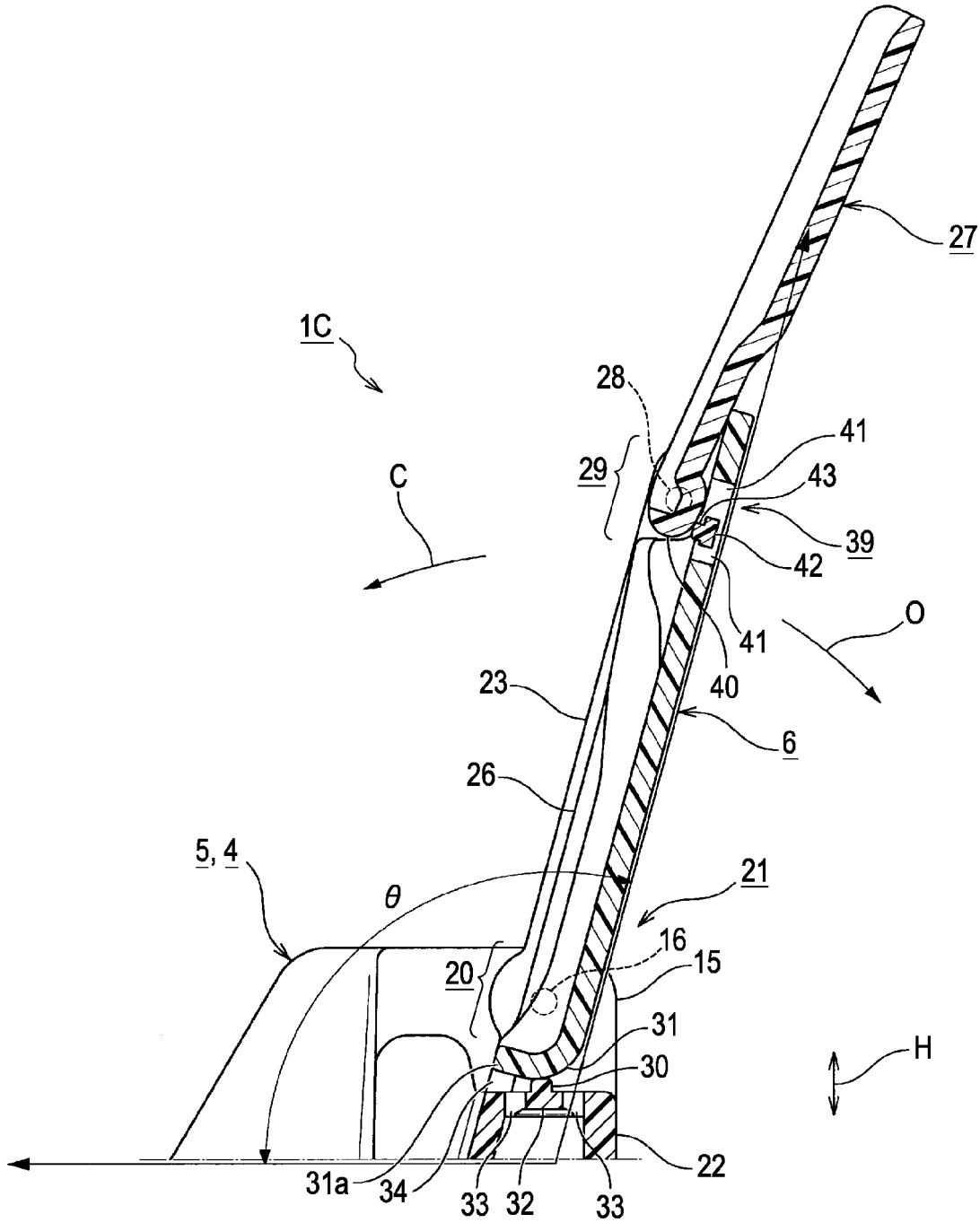
FIG. 15 is a cross-sectional side view of a recording medium support device according to another embodiment.

FIG. 15 is a cross-sectional side view of a recording medium support device according to a fourth embodiment of the invention, the device further including anti-falling mechanisms in the connection between a paper support and an auxiliary paper support. The recording medium support device, indicated at 1C, according to the fourth embodiment has the same structure as that according to the first embodiment shown in FIGS. 1 to 12 and further includes the anti-falling mechanisms, indicated at 39, between the paper support 6 and the auxiliary paper support 27, the anti-falling mechanisms 39 having the same structure as that of the anti-falling mechanism 21.

Each anti-falling mechanism 39 has a contact face 40 arranged on the auxiliary paper support 27, an elastic support member 42, which is arranged in the paper support 6 and includes slits 41, 41, and an anti-falling protrusion 43 supported by the elastic support member 42. Since the structure of the contact face 40, that of the slit 41, that of the elastic support member 42, and that of the anti-falling protrusion 43 in each anti-falling mechanism 39 with the above-described structure are the same as those of the contact face 31, the slit 33, the elastic support member 32, and the anti-falling protrusion 30 in each anti-falling mechanism 21 in the first embodiment, the detailed description thereof is omitted. The anti-falling mechanism 39 has the same advantages as those of the anti-falling mechanism 21 in the first embodiment.

Other Embodiments

The paper support 6 to which the invention is applied may have no auxiliary paper support 27. If the paper support 6 has the auxiliary paper support 27, the auxiliary paper support 27 is not limited to the rotating type. The sliding type may be used. In addition, the recording medium support device according to each embodiment can be applied not only to the medium-sized, general-purpose ink jet printer 100 but also to a small-sized portable ink jet printer 100. Furthermore, the recording medium support device according to each embodiment can be applied to a manual feed tray of a laser printer or a copy machine and a feed tray of a facsimile.

What is claimed is:

1. A recording medium support device comprising:

a feed tray capable of receiving stacked recording media;

a recording medium support pivotably connected to the feed tray, the support being switchable between a closing position and an opening position by pivoting; and an anti-falling section that prevents the recording medium support from falling to the closing position by coming into contact with the base of the recording medium support in the opening position, wherein the anti-falling section includes:

an anti-falling protrusion arranged on the feed tray; and a contact face arranged on the recording medium support so as to come into contact with the anti-falling protrusion, wherein the contact face is formed so that as the recording medium support is pivoted from the opening position to the closing position, the distance between a portion of the contact face directly across from the protrusion against which the protrusion makes instantaneous contact and a rotation shaft of the recording medium support increases, wherein the anti-falling protrusion is arranged on the feed tray through an elastic support member, the anti-falling protrusion being located substantially in the center surface of the elastic support member, the elastic support member being located between two slits on the surface of the feed tray.

2. The device according to claim 1, wherein the elastic support member is bendable when the recording medium support is opened or closed.

3. A recording apparatus comprising:

the recording medium support device according to claim 1.

4. A recording medium support device comprising:

a feed tray capable of receiving stacked recording media;

a recording medium support pivotably connected to the feed tray, the support being switchable between a closing position and an opening position by pivoting; and an anti-falling section that prevents the recording medium support from falling to the closing position by coming into contact with the base of the recording medium support in the opening position, wherein the anti-falling section includes:

an anti-falling protrusion arranged on the feed tray; and a contact face arranged on the recording medium support so as to come into contact with the anti-falling protrusion, wherein the contact face is formed so that as the recording medium support is pivoted from the opening position to the closing position, the distance between a portion of the contact face directly across from the protrusion and a rotation shaft of the recording medium support against which the protrusion makes instantaneous contact increases, wherein the anti-falling protrusion is arranged on the feed tray through an elastic support member, the anti-falling protrusion being located substantially in the center surface of the elastic support member, the elastic support member being located between two slits on the surface of the feed tray, and wherein the feed tray includes one or more raised portions configured to prevent movement of the recording medium, the one or more raised portions being closer to an edge of the feed tray than the elastic support member.

* * * * *